United States Patent [19]

Jingu et al.

[11] Patent Number: 4,961,657

[45] Date of Patent: Oct. 9, 1990

[54] RECORD MEDIA DRIVE MECHANISM FOR DOT MATRIX PRINTER

[75] Inventors: Toshihiro Jingu, Hiratsuka; Masao Kusayanagi, Odawara, both of Japan

[73] Assignee: NCR Corporation, Dayton, Ohio

[21] Appl. No.: 384,204

[22] Filed: Jul. 24, 1989

[30] Foreign Application Priority Data

Sep. 16, 1988 [JP] Japan ..... 63-230163

[51] Int. Cl.[5] ..... B41J 11/54

[52] U.S. Cl. ..... 400/599; 400/607.2; 400/608.3; 400/636.2

[58] Field of Search ..... 400/617, 625, 636–641, 400/586, 595, 599, 607.2, 608.3

[56] References Cited

U.S. PATENT DOCUMENTS

| | | | |
|---|---|---|---|
| 3,902,418 | 9/1975 | Morishita et al. | 400/586 |
| 4,188,138 | 2/1980 | Yamazaki | 400/586 |
| 4,262,894 | 9/1978 | Marano | 400/639.1 |
| 4,422,782 | 12/1983 | Lawter et al. | 400/636 |
| 4,657,420 | 4/1987 | Kondo . | |
| 4,662,765 | 5/1987 | Kapp et al. | 400/607.2 |
| 4,671,441 | 6/1987 | Hauslaib . | |
| 4,688,958 | 8/1987 | Tajima . | |
| 4,865,305 | 7/1989 | Momiyama et al. | 400/636 |

FOREIGN PATENT DOCUMENTS

| | | | |
|---|---|---|---|
| 151383 | 9/1982 | Japan | 400/639.2 |

*Primary Examiner*—Edgar S. Burr
*Assistant Examiner*—Joseph R. Keating
*Attorney, Agent, or Firm*—Wilbert Hawk, Jr.; Albert L. Sessler, Jr.; George J. Muckenthaler

[57] ABSTRACT

A rotating and driving mechanism for a record media feed roller adjacent a printing station. The feed roller is supported by the platen assembly and is movable therewith to provide a path for the record media through the printing station. A plate member is pivotally supported on an adjacent feed roller and includes slots therein. A cam member is positioned between a side frame and the plate member and includes pins for operating in the slots of the plate member and has a surface engaging with the shaft of the feed roller. Rotatable means is provided for moving the platen assembly to form the record media path. The rotatable means includes an arm for limiting movement of the plate member relative to rotational forces derived when driving the feed roller to advance the record media through the printing station.

20 Claims, 5 Drawing Sheets

24
78
72
88
66
64
74
132
80
49
56
50
52
48
124
22
24

78
72
88
66
64
74
132
80
52
56
50
33
124
22
24

RECORD MEDIA DRIVE MECHANISM FOR DOT MATRIX PRINTER

BACKGROUND OF THE INVENTION

In the field of printing, the most common type printer has been the printer which impacts against record media that is caused to be moved past a printing line or line of printing. As is well-known, the impact printing operation depends upon the movement of impact members, such as print hammers or wires or the like, which are typically moved by means of an electromechanical drive system and which system enables precise control of the impact members.

In the field of dot matrix printers, it has been quite common to provide a print head which has included therein a plurality of print wire actuators or solenoids arranged or grouped in a manner to drive the respective print wires a very short, precise distance from a rest or non-printing position to an impact or printing position. The print wires are generally either secured to or engaged by the solenoid plunger or armature which is caused to be moved such precise distance when the solenoid coil is energized and wherein the plunger or armature normally operates against the action of a return spring.

It has also been quite common to provide an arrangement or grouping of such solenoids in a circular configuration to take advantage of reduced space available in the manner of locating the print wires in that specific area between the solenoids and the front tip of the print head adjacent the record media. In this respect, the actuating ends of the print wires are positioned in accordance with the circular arrangement and the operating or working ends of the print wires are closely spaced in vertically-aligned manner adjacent the record media. The availability of narrow or compact actuators permits a narrower or smaller print head to be used and thereby reduces the width of the printer because of the reduced clearance at the ends of the print line. The print head can also be made shorter because the narrow actuators can be placed in side-by-side manner closer to the record media for a given amount of wire curvature.

In the wire matrix printer which is utilized for receipt and for journal printing operations, the print head structure may be a multiple element type and may be horizontally disposed with the wire elements aligned in a vertical line and supported on a print head carriage which is caused to be moved or driven in a horizontal direction for printing in line manner across the receipt or journal paper and wherein the drive elements or transducers may be positioned in a circular configuration with the respective wires leading to the front tip of the print head. In the wire matrix printer which is utilized for business forms or like record media printing operation, the print head may be oriented in a manner wherein the nose is pointed downward for printing on the form, slip or like record media while the carriage and print head are moved above and across the form or like record media in the horizontal direction.

Further, in the wire matrix printer which is utilized for receipt, slip and journal printing operations, the individual print heads may be vertically oriented and printing performed by means of the print wires moving downwardly to impact on the record media. Alternatively, the individual print heads may be horizontally oriented and printing performed by means of the print wires moving horizontally to impact on the record media. A preferred number of four of such individual print heads is common in known arrangements. The dot matrix printer is commonly used in an electronic cash register (ECR) or in a point of sale (POS) terminal.

In the dot matrix printer, there is a requirement for one or more small electric motors to drive certain parts of the printer. A small motor is used to drive the print head carriage in reciprocating manner in the printer that includes a stationary platen and a movable print head. The print head carriage and the associated print head are moved to appropriate and precise locations along the line of printing for dot matrix printing of alpha numeric characters or of graphics type characters. A second motor is used to drive the paper such as a receipt, a slip or a journal at the end of the printing operation and which paper drive is usually performed at the end of each line of printing. However, it is feasible to advance the paper at the end of the printing on a line without the necessity of moving the carriage and print head to the end of such line. This arrangement enables faster printing operation.

Additionally, in the dot matrix printer which is used for receipt, slip and journal printing operations, the receipt paper from a supply roll thereof is driven through the receipt/slip printing station. The receipt/-slip printing station is also used for printing on a slip or like business form.

Representative documentation in the field of dot matrix printers includes H. Kondo U.S. Pat. No. 4,657,420, issued on Apr. 14, 1987, discloses a paper feed mechanism having first and second rotating members and first and second passing members coupled to selectively engage with the first or the second rotating member.

W. Hauslaib U.S. Pat. No. 4,671,441, issued on June 9, 1987, discloses two paper feed paths which are selectively arranged by link coupling means and electric switching means.

A. Tajima U.S. Pat. No. 4,688,958, issued on Aug. 25, 1987, discloses a paper feeding mechanism including a cam portion having a curved slot for receiving a pin of a bar connecting with a paper pressing lever.

SUMMARY OF THE INVENTION

The present invention relates to dot matrix printers and is directed to a dot matrix printer of compact size for impact printing on record media and including a plurality of printing stations. The plurality of printing stations are used in an electronic cash register (ECR) or a point of sale (POS) terminal for printing on two or more record media. More particularly, the invention is directed to a two station printer, one station being positioned near the front of the printer and utilized for dot matrix printing on a receipt and a slip. The second station is positioned near the rear of the printer and is utilized for dot matrix printing on a journal. The two stations are disposed relative to each other in tandem manner and the print head carriages (front and rear) are driven by a single drum type cam common to and positioned between the two carriages. The two carriages along with the associated print heads are driven by the drum type cam an equal distance in opposite directions during printing operations. The one station near the front of the printer is referred to as the receipt/slip printing station and the other station rearwardly of the one station is referred to as the journal printing station.

The receipt/slip printing station includes six single wire solenoids, aligned across and supported by the front carriage. The solenoids are vertically oriented for printing downwardly on receipt paper or on a slip disposed on a fixed platen.

The journal printing station also includes six single wire solenoids, aligned across and supported by the rear carriage. The solenoids are horizontally oriented for printing in the rearward direction against journal paper driven past a fixed platen.

The single drum type cam drive is positioned between the receipt/slip station and the journal station. The drum cam includes a rail on the periphery thereof which engages with a pair of rollers on each print head carriage. Rotation of the drum cam in a predetermined direction causes the receipt/slip print head carriage to move in one direction across the printer and causes the journal print head carriage to move an equal distance in the opposite direction.

A receipt paper roll is disposed rearwardly and downwardly of the receipt/slip station and receipt paper is driven across the platen for printing on the paper. A knife mechanism is provided at the front of the printer for cutting the receipt paper after printing thereon. The printer also includes a slip table positioned for receiving a slip for printing thereon at the receipt/-slip station.

In accordance with the present invention, there is provided a record media drive mechanism for a dot matrix printer comprising spaced side frames, a first roller having a first shaft journaled in said side frames and including a first gear secured to one end of said first shaft, a second feed roller having a second shaft journaled in said side frames and including a second gear secured to one end of said second shaft, said first feed roller and said second feed roller being spaced from each other and positioned to feed record media through the printing station of said printer, an arm pivoted on said second shaft and having a stud at one end thereof and a gear at the other end thereof engaging with said first gear and with said second gear, means for rotating said first feed roller, said arm being responsive to rotation of said first feed roller, and cam means operably associated with said arm and in contact with said first shaft for controlling the pivoting of said arm.

In view of the above discussion, a principal object of the present invention is to provide an improved record media drive mechanism for a dot matrix printer.

Another object of the present invention is to provide a positive drive mechanism for record media in a dot matrix printer.

An additional object of the present invention is to provide drive mechanism including a first feed roller and a second feed roller coupled by means of an intermediate member for ensuring correct feeding of record media.

A further object of the present invention is to provide drive mechanism having a first feed roller and a second feed roller and cam means coupling said feed rollers and controlling rotation of said rollers for correctly feeding one or another type of record media for printing thereon.

Additional advantages and features of the present invention will become apparent and fully understood from a reading of the following description taken together with the annexed drawing.

DESCRIPTION OF THE PREFERRED EMBODIMENT

Figure 1:
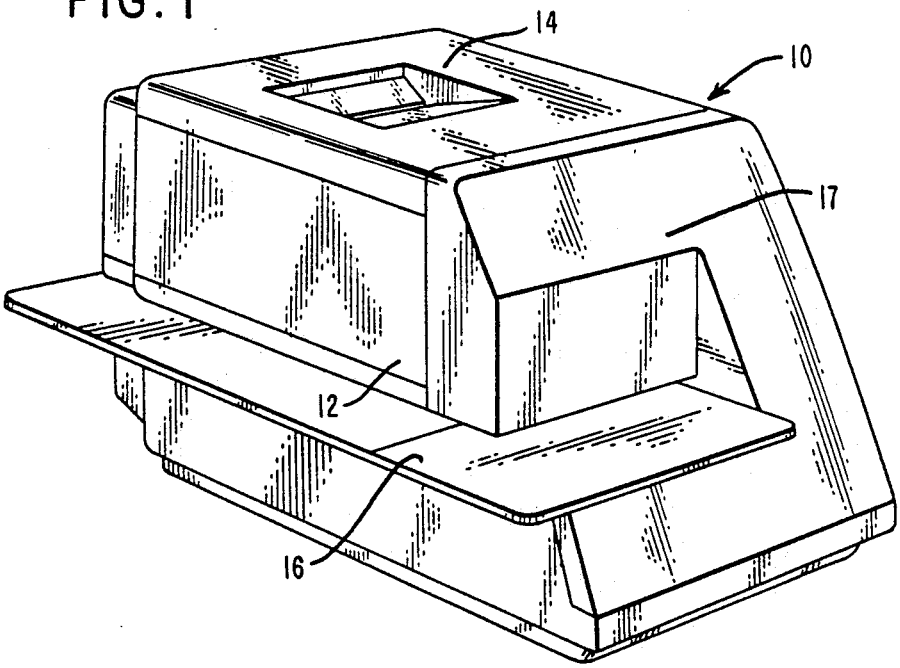
FIG. 1 is a perspective view of a dot matrix printer incorporating the subject matter of the present invention.

Referring now to FIG. 1, a printer 10 is designed as a two station, receipt/slip and journal printer. The receipt/slip printing station occupies a front portion 12 and the journal printing station occupies a rearward portion 14 of the printer. A slip table 16 is provided along the left hand side of the printer 10. A front cover 17 swings toward the right to expose certain operating parts of the printer 10.

Figure 2:
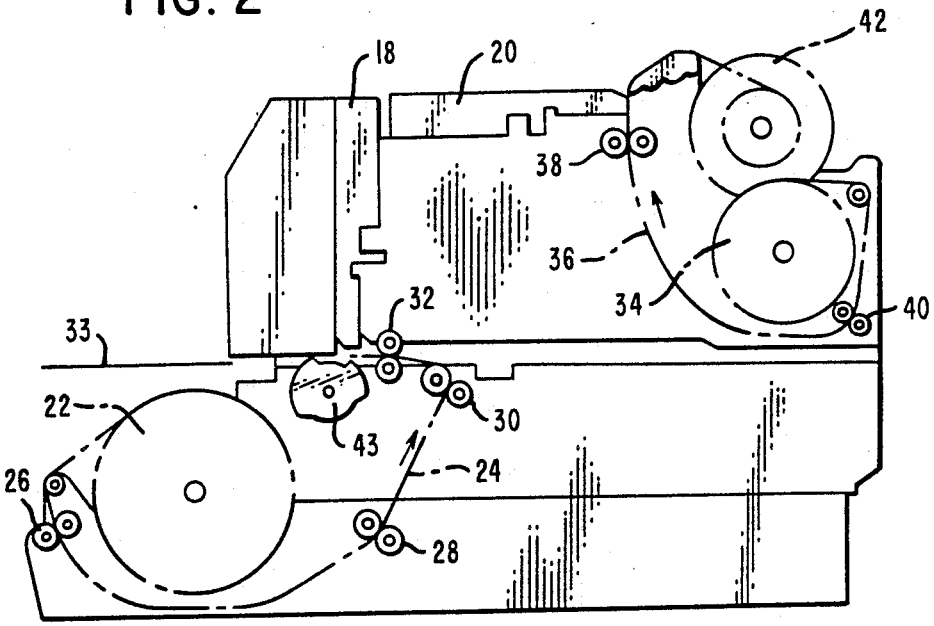
FIG. 2 is a right side elevational view in diagrammatic form showing the arrangement of certain elements of the printer.
Figure 3:
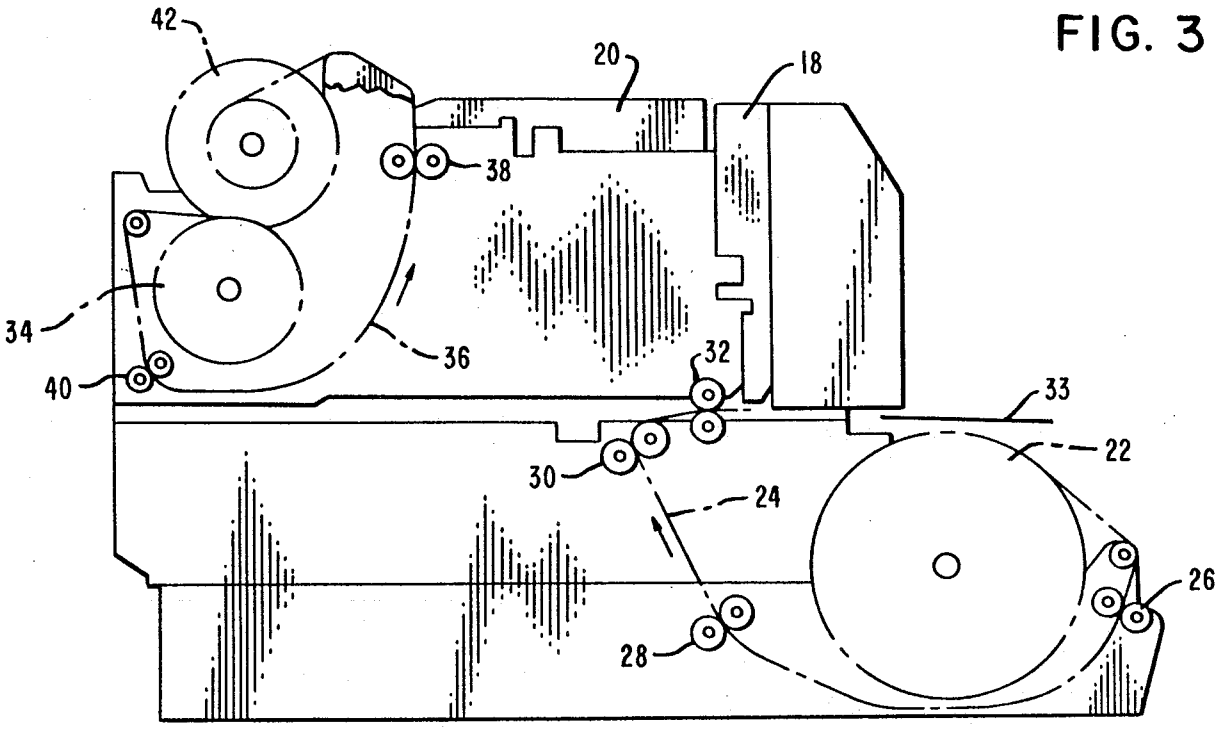
FIG. 3 is a left side elevational view in diagrammatic form showing the arrangement of such certain elements of the printer.

FIGS. 2 and 3 are right and left side elevational views and show certain elements of the printer 10 in diagrammatic form. The receipt/slip portion 12 and the journal portion 14 include individual print wire solenoids (not shown) along with a ribbon cassette 18 for the receipt/-slip printing operation and a ribbon cassette 20 for the journal printing operation. A roll 22 of receipt paper is journaled at the front of the printer 10 and the receipt paper 24 is driven and guided by appropriate pairs of rollers, as 26, 28, 30 and 32 in a path past the receipt/slip printing station for printing operation and for issuance of a receipt 33 after cutting thereof from the receipt paper 24. A supply roll 34 of journal paper is positioned in a cradle at the rear of the printer 10 and the journal paper 36 is driven and guided by appropriate pairs of rollers, as 38 and 40, in a path from the supply roll 34, past the journal printing station, and onto a take-up roll 42. A timing plate 43 (FIG. 2) is provided at the receipt/slip printing station for positioning the receipt/-slip feed rolls.

Figure 4:
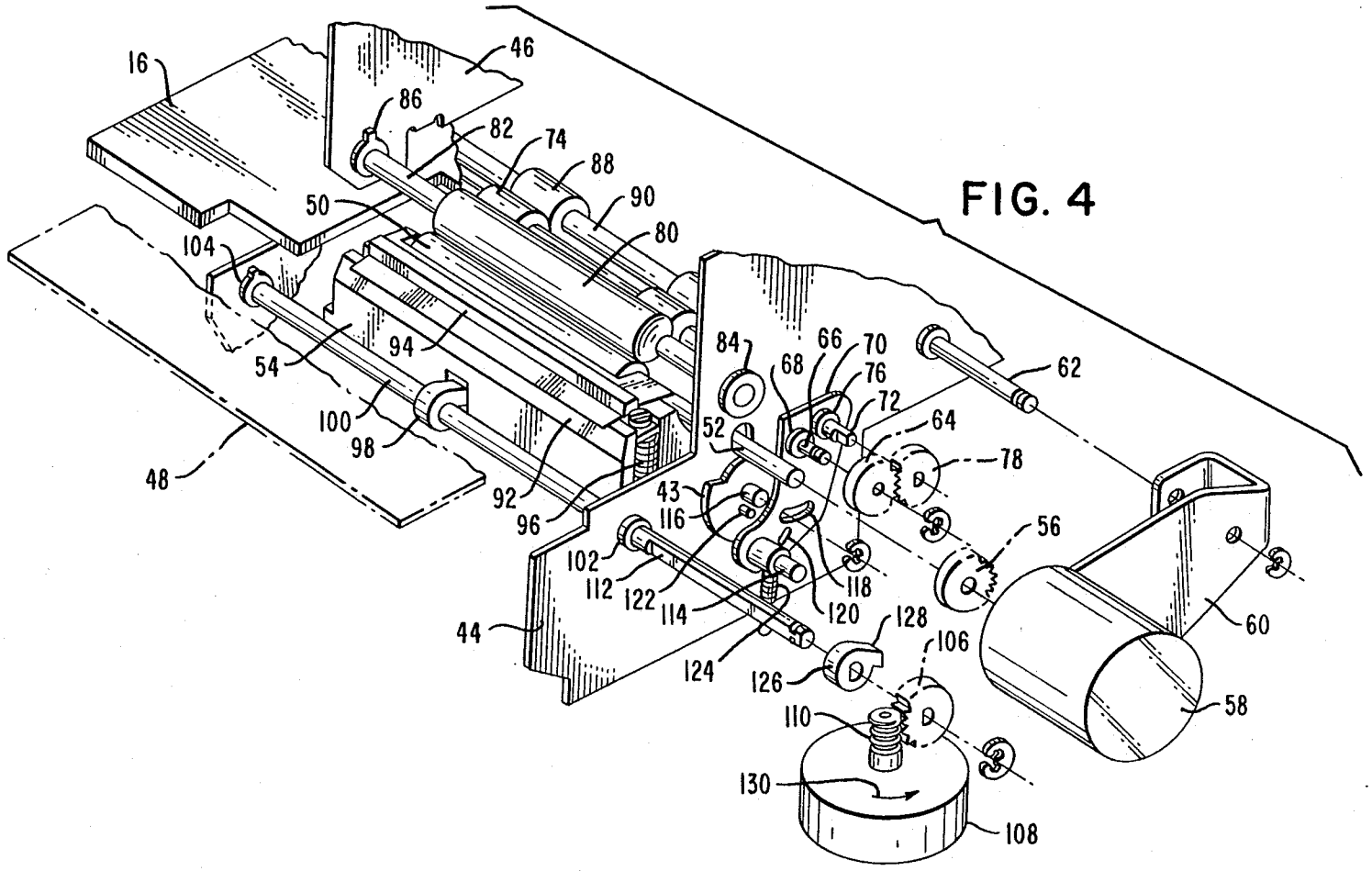
FIG. 4 is a perspective view showing structure of a preferred embodiment of the present invention, certain of the parts being shown in exploded manner for clarity.

FIG. 4 is a perspective view of the record media feed mechanism according to a preferred embodiment of the present invention. Prior to describing the invention in detail, it is convenient to mention certain aspects of a record media feed operation. In a printer for printing on receipt paper and on a slip at one printing station, the receipt paper and the slip are changed in accordance with the desired printing operation. When the slip is to be printed, the receipt paper is retracted from the printing station before the slip is inserted into the printer and the slip is then driven or advanced to the proper position for printing operation. A feature of the slip printing operation is the opening and closing of the feed rollers for enabling insertion and withdrawal of the slip at the printing station. When printing is to be performed on the receipt paper, the slip is removed from the printing station and the receipt paper is advanced to the proper position for printing operation. A plurality of feed rollers are provided for feeding the receipt paper and the slip and a gear train is used for rotating and driving the feed rollers by a single motor.

Referring now to FIG. 4, the printer includes spaced, side plates 44 and 46 for supporting the various parts of the record media drive mechanism. The slip table 16 is shown at the left side and a slip 48 (shown in phantom line) occupies a position at the front of the printer for printing operation. A main feed roller 50 is carried on a shaft 52 that is supported in a platen assembly 54 between the side plates 44 and 46. The shaft 52 extends through an opening in the right side plate 44 and a gear 56 is secured on the shaft 52. The shaft 52 is coupled to a motor 58 which is swingably supported on a support bracket 60 that is journaled on a shaft 62 secured to the side plate 44. The motor 58 is swingable from the shaft 62 to move in accordance with movement of the main feed roller 50 when accommodating the receipt paper 24 and the form 48. A port 49 opens when feed roller 50 is moved down to enable insertion of the slip or form 48.

A gear 64 is secured to a shaft 66 that is journaled in a bearing 68 in a plate 70 pivotally supported on a shaft 72 that carries a feed roller 74. The shaft 72 is journaled in a bearing 76 in the plate 70 and a gear 78 is secured to the shaft 72. The gear 64 operates as an intermediate or transmitting gear by reason of engaging with the gear 56 and with the gear 78 so as to transmit the drive from the gear 56 to the feed roller 74. A pressure roller 80 is carried on a shaft 82 suitably journaled in bearings 84 and 86 in the side plates 44 and 46 to cooperate with the main feed roller 50 on the shaft 52. A pressure roller 88 is carried on a shaft 90 suitably supported to cooperate with the feed roller 74 on the shaft 72.

The platen assembly 54 includes a support structure 92 that carries the main feed roller 50 and a platen 94. The platen 94 is supported by a spring 96 at each end of the platen to maintain the platen in position at the printing station. The platen 94 is moved down against the action of the springs 96 by means of an arm 98 secured to a rotatable shaft 100. The shaft 100 is journaled in bearings 102 and 104 in the side plates 44 and 46 and extends a predetermined distance beyond the plate 44. A gear 106 is secured to the shaft 100 and a motor 108 has a threaded shaft 110 that meshes with gear 106 to rotate the shaft 100. Shaft 100 has a flat portion 112 outside the plate 44.

The arm 70, in the form of an irregular plate, journals the shaft 66 with the gear 64 secured thereon. The shaft 72 is journaled in the arm 70 and has the gear 78 secured to the shaft 72 which provides a pivot means for the arm 70. A stud 114 is secured to the arm 70 at the other end thereof from the gear 64.

The timing plate 43, in the form of a cam, is rotatably carried on a stud 116 secured to the right side plate 44. It should be noted that the shafts 52 and 82 for the drive roller 50 and the pressure roller 80 are supported in aligned manner and that the stud 116 is aligned with shafts 52 and 82. The plate 43 defines a wide slot 118 therein for the stud 116, the slot 118 being slightly arcuate to accommodate rotation of the plate 43 and travel of the stud 116 along the slot 118. The plate 43 also defines a narrow slot 120 therein for a pin 122 that is secured to the timing plate 43. A coil spring 124 is coupled to the stud 114 and to a frame portion (not shown) of the printer 10 to tend to rotate the arm 70 in a counterclockwise direction (FIGS. 5A and 5B) so that the gear 64 is meshed with the gear 56.

A stopper 126, in the form of an arm, is secured to the shaft 100 and is fitted on the flat portion 112 thereof. An end portion 128 of the stopper 126 engages with the stud 114 (FIG. 5A) upon rotation of the shaft 100 to prevent clockwise rotation of the arm 70 about the shaft 72. The motor 108 operates to rotate the shaft 100 through the gear 106 on the shaft 100 and the warm gear 110 on the shaft of the motor to control the downward movement of the platen assembly 54 with the drive roller 50 as a part of such assembly.

Figure 5B:
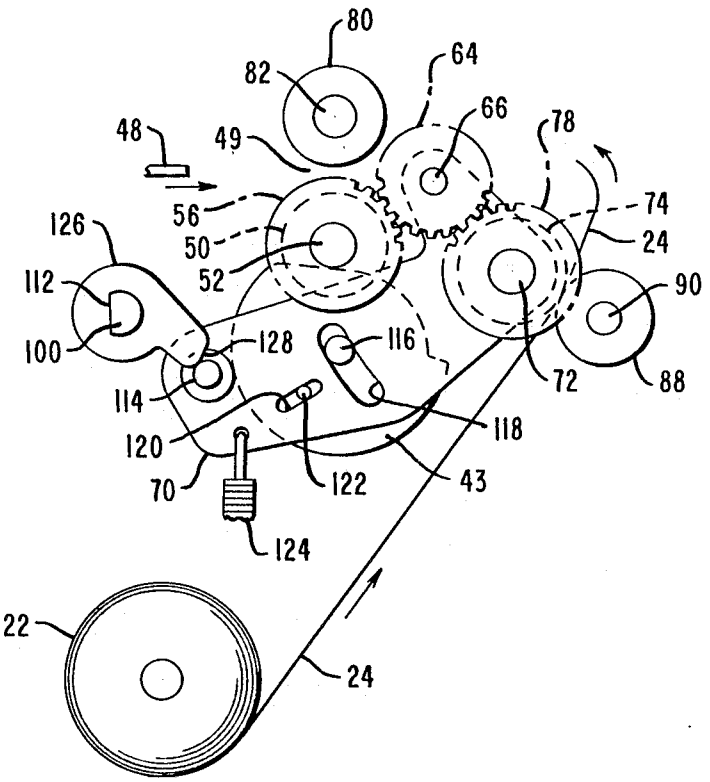
FIGS. 5A and 5B are side elevational views of the structure of FIG. 4 and illustrating the arrangement of the parts for driving two types of record media for printing operation.
Figure 5A:
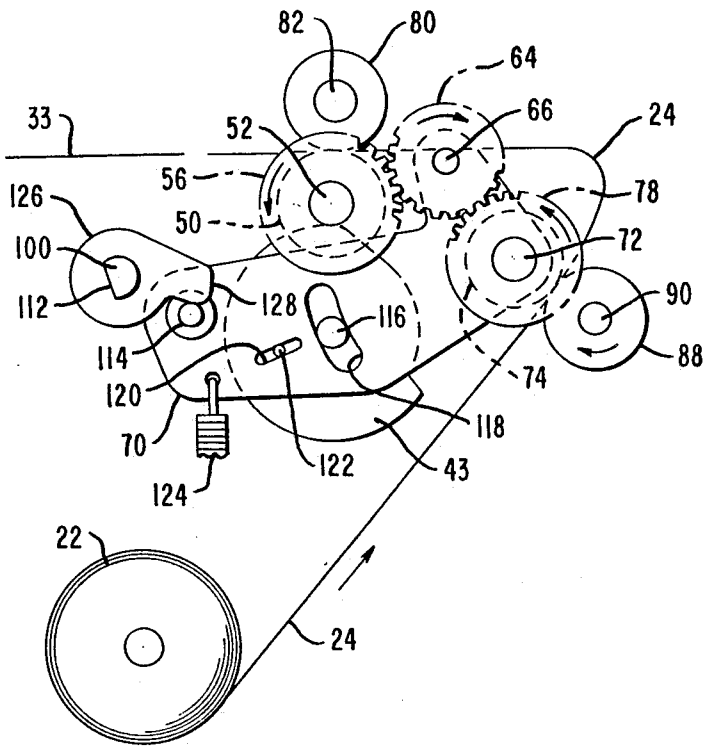

In the operation of the drive roller 50 and its associated parts, reference is made to FIGS. 5A and 5B. FIG. 5A shows the positions of the drive roller 50 and of the pressure roller 80 for holding the receipt paper 24 during advancement thereof. FIG. 5B shows the positions of the drive roller 50 and of the pressure roller 80 wherein the drive roller is lowered so as to permit entry and removal of the slip 48. Of course, the drive roller 50 is moved upward to advance the slip 48 to the correct printing location.

When the motor 108 (FIG. 4) rotates in the direction of the arrow 130, the shaft 100 is rotated clockwise (FIGS. 5A and 5B) through the warm gear 110 and the gear 106 and the platen assembly 54 is moved down by the action of the arm 98 on the shaft 100 which arm is engaged with the platen assembly 54. Since the drive roller 50 is a part of the platen assembly 54, the drive roller is moved down and away from the pressure roller 80 and the gear 56 is also moved down at the same time as the platen assembly.

The arm 70 rotates counterclockwise on the shaft 72 as the gear 56 is moved down. It is seen that the gear 64 is moved with gear 78 engaged therewith to the position shown in FIG. 5B. When the arm 70 rotates counterclockwise, the pin 122 in the slot 120 of the timing plate 43 causes the timing plate to rotate at the same time to the position in FIG. 5B wherein the cam surface of the plate 43 prevents any further lowering of the shaft 52 of the gear 56. Since the shaft 52 is located directly above the stud 116 of the timing plate 43, any downwardly acting force applied from the shaft 52 will not cause the timing plate to rotate. When the gear 56 is rotated in the position shown in FIG. 5B, the shaft 52 of the gear is also rotated while in contact with the cam surface of the plate 43. Generation of friction between the shaft 52 and the surface of the cam plate 43 can be avoided by making the cam plate of oil-impregnated plastic or metal.

It is also seen that when the platen assembly 54 is moved down by rotation of the shaft 100, the stopper 126 is rotated from the position wherein the end portion 128 is above the stud 114 on the arm 70 (FIG. 5A) to the position wherein the end portion 128 is engaged with the stud 114 (FIG. 5B). In this position of the parts, the arm 70 can not rotate in the clockwise direction. When the gear 56 is rotated clockwise, a force is acting in a direction to maintain engagement of the teeth of gear 56 with the teeth of gear 64.

Figure 6B:
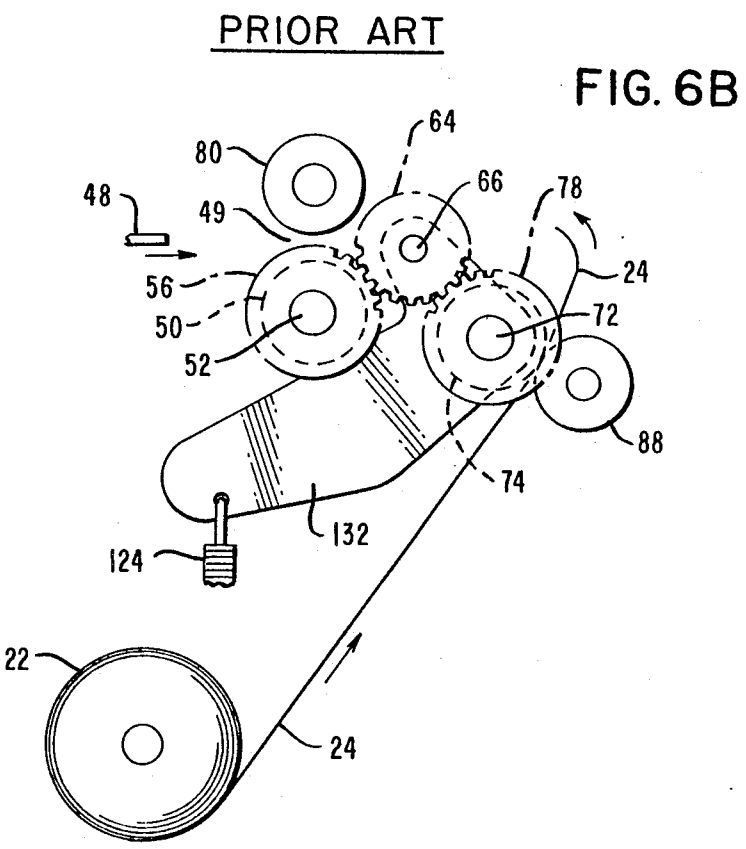
PRIOR ART FIG. 6B
FIGS. 6A and 6B are similar views and showing drive mechanism in a conventional printer.
Figure 6A:
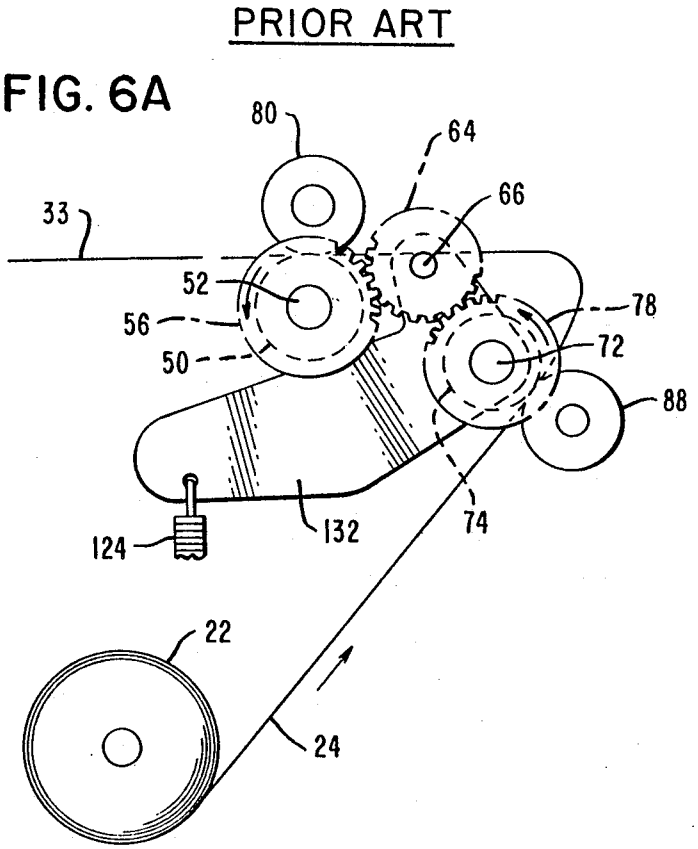
PRIOR ART FIG. 6A

FIGS. 6A and 6B show portions of a printer having a conventional arrangement of the drive rollers. Since may of the parts of the conventional arrangement are the same as the parts already described in FIGS. 5A and 5B, the same reference numerals will be used for such parts. The conventional arrangement includes the supply roll 22 for the receipt paper 24, the drive roller 74 and associated pressure roller 88, and the drive roller 50 and associated pressure roller 80. The conventional arrangement also includes the gear 56, the intermediate gear 64 and the gear 78 on associated shafts 54, 66 and 72.

FIG. 6A shows the position of the parts in a conventional gear mechanism wherein the gear 56 is in the normal receipt paper advancing position and the gear 56 is driven by a suitable motor (not shown). When the gear 56 is driven in a counterclockwise direction, the drive roller 50 is rotated, with the help of the pressure roller 80, to advance the receipt paper 24 toward the left in FIG. 6A. A receipt 33 is shown after printing on the receipt paper 24 and cutting thereof. Rotation of gear 56 rotates the intermediate gear 64 and the gear 78 which drives the feed roller 74 for advancing the receipt paper 24 from the supply roll 22.

FIG. 6B shows the position of the parts in a conventional gear mechanism wherein the gear 56 has been moved down and the drive roller 50 is separated from the pressure roller 80 to provide the post 49 for the slip 48. An arm 132 is pivoted on the shaft 72 that carries the feed roller 74, such arm being biased by the spring 124. When the gear 56 is moved down, the arm 132 is rotated counterclockwise by the spring 124, so that engagement of the gear 56 and the gear 64 on the arm 132 is maintained.

It is seen that the gear 64 is pressed against the gear 56 only by the tensile force of the spring 124. When the gear 56 is rotated counterclockwise to feed the receipt paper 24, the gear 56 kicks the gear 64 into rotation and a force is generated to cause the arm 132 to rotate clockwise against the tensile force of the spring 124. The spring 124 also tends to provide a force which will cause the arm 132 to be biased in the counterclockwise direction and, by engagement of gear 64 with gear 56, tends to move the gear 56 down and away from the pressure roller 80. In a normal situation, these forces are balanced to correctly feed the receipt paper 24.

However, in case of a force on the gear 56 that is greater than that of the spring 124 acting on the arm 132, the gear 56 may be moved down and the feed roller 50 may not correctly advance the paper 24. For example, the supply roll 22 may contact the side wall of the container thereof (not shown) and increase the frictional force so that the arm 132 tends to rotate against the tensile force of the spring 124. This may cause skipping of the teeth between gears 56 and 64 and cause problems in advancing or feeding of the receipt paper 24.

It is thus seen that herein shown and described is a compact dot matrix printer that includes a paper mechanism wherein a cam member is provided for limiting the movement of the feed roller and a stop member for avoiding rotation of an arm carrying a transmitting gear. The apparatus and arrangement enable the accomplishment of the objects and advantages mentioned above, and while the preferred embodiment of the invention has been disclosed herein, variations thereof may occur to those skilled in the art. It is contemplated that all such variations not departing from the spirit and scope of the invention hereof are to be construed in accordance with the following claims.

What is claimed is:

1. A drive mechanism for record media comprising a first feed roller carried on a first shaft having a first gear at one end thereof, a second feed roller carried on a second shaft having a second gear at one end thereof, an intermediate gear positioned to mesh with said first gear and with said second gear, an arm pivotally supported on said second shaft and biased in one direction, said intermediate gear being journaled on said arm at one end thereof and said arm having a stud at the other end thereof, means for driving said first feed roller for advancing said record media, means for moving said first feed roller to provide a path for said record media, cam means operably associated with said arm to rotate therewith and having a cam surface engaging with said first shaft, and means operably associated with said means for moving said first feed roller and engageable with said stud on said arm for limiting the rotation of said arm and the movement of said first feed roller.

2. The drive mechanism of claim 1 including a first pressure roller and a second pressure roller operably associated with said first feed roller and with said second feed roller, respectively.

3. The drive mechanism of claim 1 wherein said arm comprises a plate member for journaling said second gear and said intermediate gear at one end thereof.

4. The drive mechanism of claim 1 wherein said means for driving said first feed roller comprises a motor support in pivoting manner.

5. The drive mechanism of claim 1 wherein said means for moving said first feed roller comprises a shaft, an arm secured to the shaft and operably coupled to the first feed roller, and a motor for rotating said shaft.

6. The drive mechanism of claim 1 wherein said arm defines a first opening therein and said cam means comprises a plate member having a first stud operably associated with said first opening permitting moving of said cam means with said arm.

7. The drive mechanism of claim 1 wherein said arm defines a second opening therein and said cam means comprises a plate member having a second stud operably associated with said second opening for limiting rotation of said arm relative to movement of said first feed roller.

8. The drive mechanism of claim 6 wherein said first opening comprises an arcuately-shaped slot.

9. The drive mechanism of claim 7 wherein said second opening comprises a slot.

10. The drive mechanism of claim 1 wherein said arm defines a first slot centrally located therein and said cam means includes a first stud operating in said first slot and said arm defines a second slot substantially perpendicular to said first slot and said cam means includes a second stud operating in said second slot.

11. A drive mechanism for use in a printer having spaced side frames, a printing station for printing on record media, said printing station including a platen assembly, and means for advancing said record media through said printing station, said drive mechanism comprising a first feed roller supported by said platen assembly and carried on a first shaft, a second feed roller carried on a second shaft journaled in said spaced side frames, an arm pivotally supported at one end thereof on said second shaft and said arm having a stud at the other end thereof, means for urging said arm in one direction of rotation around said second shaft, drive means for moving said first feed roller to provide a path at said printing station for advancing said record media therethrough, cam means operably associated with said arm to rotate therewith and engaging with said first shaft, and means operably associated with said drive means and engageable with said stud on said arm for stopping rotation of said arm due to the movement of said first feed roller relative to forces generated by said means for advancing said record media through said printing station.

12. The drive mechanism of claim 11 including a first pressure roller and a second pressure roller operably associated with said first feed roller and with said second feed roller, respectively, for advancing said record media through said printing station.

13. The drive mechanism of claim 11 wherein said arm comprises an irregularly-shaped plate member adjacent one of the spaced side frames.

14. The drive mechanism of claim 11 wherein said urging means comprises a coil spring connected to the stud on said arm and to one side frame of said printer.

15. The drive mechanism of claim 11 wherein said drive means includes a shaft journaled in said spaced side frames, an arm secured to the shaft and operably coupled with said platen assembly and a motor for rotating said shaft.

16. The drive mechanism of claim 11 wherein said cam means comprises a plate member positioned between one of said side frames and said arm and having a cam surface engaging with said first shaft of said first feed roller.

17. The drive mechanism of claim 11 wherein said arm defines a first opening therein and said cam means comprises a plate member having a first stud operating in said first opening permitting moving of said plate member with said arm.

18. The drive mechanism of claim 17 wherein said arm defines a second opening therein and said cam means comprises a plate member having a second stud operating in said second opening for limiting rotation of said arm relative to movement of said first feed roller.

19. The drive mechanism of claim 11 wherein said arm defines a first centrally located slot therein and a second slot spaced from said first slot, a first pin operating in the first slot and a second pin operating in the second slot.

20. The drive mechanism of claim 19 wherein said first shaft is arcuately shaped and said second slot is linear shaped and normal to said first slot.

* * * * *